US010118677B2

(12) United States Patent
Zapata

(10) Patent No.: US 10,118,677 B2
(45) Date of Patent: Nov. 6, 2018

(54) DEVICE AND SYSTEM FOR PROPELLING A PASSENGER

(71) Applicant: ZIPH2O, Le Rove (FR)

(72) Inventor: Franky Zapata, Le Rove (FR)

(73) Assignee: ZIPH2O, Le Rove (FR)

( * ) Notice: Subject to any disclaimer, the term of this patent is extended or adjusted under 35 U.S.C. 154(b) by 0 days.

(21) Appl. No.: 15/123,661

(22) PCT Filed: Mar. 21, 2014

(86) PCT No.: PCT/FR2014/050673
§ 371 (c)(1),
(2) Date: Sep. 5, 2016

(87) PCT Pub. No.: WO2015/132478
PCT Pub. Date: Sep. 11, 2015

(65) Prior Publication Data

US 2017/0080997 A1 Mar. 23, 2017

(30) Foreign Application Priority Data

Mar. 5, 2014 (FR) ..... 11/451799

(51) Int. Cl.
*B63B 35/79* (2006.01)
*B63H 11/00* (2006.01)
(Continued)

(52) U.S. Cl.
CPC ..... *B63B 35/7943* (2013.01); *B63H 11/00* (2013.01); *B63H 11/107* (2013.01);
(Continued)

(58) Field of Classification Search
CPC ... B63B 35/7943; B63H 11/113; B63H 11/00; B63H 11/107; B63H 2011/006; B63H 2011/008
See application file for complete search history.

(56) References Cited

U.S. PATENT DOCUMENTS 3,142,285 A * 7/1964 Sorrentino ..... B63H 11/00 440/42
3,243,144 A 3/1966 Moore et al.
(Continued)

OTHER PUBLICATIONS

First Office Action dated May 4, 2010 issued in the corresponding Chinese Patent Application No. 201480078549.0 (9 pages).

*Primary Examiner* — Anthony D Wiest
(74) *Attorney, Agent, or Firm* — Buchanan Ingersoll & Rooney PC

(57) ABSTRACT

A propulsion device including a platform on which a passenger is positioned, said platform comprising an upper surface and a lower surface, and cooperating with means for collecting and distributing a pressurized fluid to a primary nozzle expelling said fluid from a fluid outlet in a given direction, said means being supplied with pressurized fluid by a fluid supply conduit, the device being characterized in that: the primary nozzle is oriented substantially from the bow to the stern of the platform; the fluid expulsion direction fits in a median plane of the platform; the fluid expulsion direction of the primary nozzle describes an angle comprised between −10° and +45° with a longitudinal axis of the platform contained in said median plane.

20 Claims, 7 Drawing Sheets

(51) Int. Cl.
*B63H 11/107* (2006.01)
*B63H 11/113* (2006.01)

(52) U.S. Cl.
CPC ..... *B63H 11/113* (2013.01); *B63H 2011/006* (2013.01); *B63H 2011/008* (2013.01)

(56) References Cited

U.S. PATENT DOCUMENTS

| | | | | |
|---|---|---|---|---|
| 3,277,858 | A | 10/1966 | Athey | |
| 3,381,917 | A | 5/1968 | Moore et al. | |
| 3,492,965 | A * | 2/1970 | Wayfield | B63H 11/02 114/151 |
| 3,700,172 | A | 10/1972 | Gallegos | |
| 3,943,876 | A | 3/1976 | Kiekhaefer | |
| 5,419,514 | A | 5/1995 | Ducan | |
| 6,146,219 | A * | 11/2000 | Blanchard | B63H 11/11 114/151 |
| 6,192,817 | B1 | 2/2001 | Dec et al. | |
| 6,913,496 | B2 * | 7/2005 | Fuse | B63B 1/18 440/41 |
| 7,258,301 | B2 | 8/2007 | Li | |
| 7,614,355 | B2 | 11/2009 | Zeyger | |
| 8,336,805 | B1 | 12/2012 | Zapata | |
| 8,608,104 | B2 | 12/2013 | Zapata | |
| 9,145,206 | B1 | 9/2015 | Robinson | |
| 2008/0014811 | A1 | 1/2008 | Zeyger | |
| 2009/0325430 | A1 | 12/2009 | Erriu | |
| 2014/0263849 | A1 | 9/2014 | Li | |

* cited by examiner

FIG. 2a
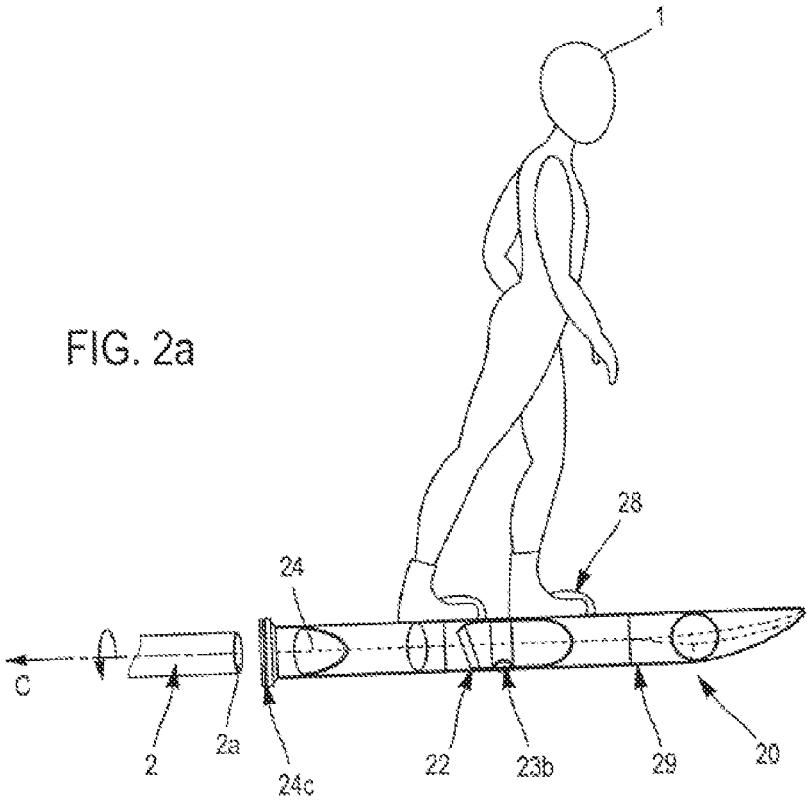
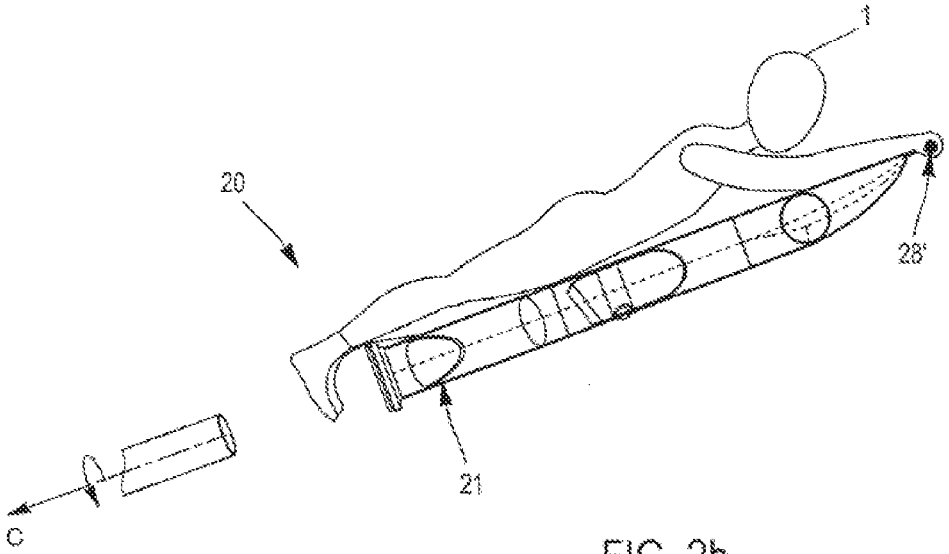
FIG. 2b

DEVICE AND SYSTEM FOR PROPELLING A PASSENGER

CROSS-REFERENCE TO RELATED APPLICATION

This application is related to and claims priority to PCT Patent Application Serial No. PCT/FR2014/050673, filed Mar. 21, 2014, entitled DEVICE AND SYSTEM FOR PROPELLING A PASSENGER, and France Patent Application Serial No. 11/451799, filed Mar. 5, 2014, entitled DISPOSITIF ET SYSTÈME DE PROPULSION, the entirety of all of which are incorporated herein by reference.

STATEMENT REGARDING FEDERALLY SPONSORED RESEARCH OR DEVELOPMENT n/a

FIELD OF THE INVENTION

The present invention relates to a device and a system for propelling a passenger so that the latter can move through the air, on the surface of a fluid or within a fluid with great freedom of movement thanks to his agility and physique.

BACKGROUND OF THE INVENTION

Today, water sports are highly appreciated for their entertaining aspect and the sensations that these sports provide. Known water sports of course include surfing. Surfing consists of gliding on waves, standing upright on a board. Different surfboards are used depending on the surfer's experience level. Surfing is indeed based on a specific principle: initially, the surfer is generally lying flat on his stomach on the board, arms on either side thereof, chest lifted. He paddles using his arms when he identifies a wave on which he wishes to glide, in order to acquire a sufficient speed for the wave to be able to carry him. When he feels the wave lift him up, he paddles more quickly, then pushes with his hands flat on the board so as to stand upright. To keep his balance, he adopts a tilted posture with bent knees. Once upright, the arms are essentially used to maintain balance and help change direction. The legs play a shock absorbing role and control the pitch of the board.

Alternatively, some surf fans enjoy bodyboarding, which is a sport similar to surfing, but done on a shorter and more flexible board. Bodyboarding is based on a principle similar to that of surfing: the "bodyboarder", i.e., the person performing the bodyboarding, is generally in an elongated position on his board, pressing on his elbows with his chest lifted and his hands placed on the nose of the board. When gliding on a wave, the bodyboarder stays in the elongated position. However, adventurous bodyboarders may sometimes be in a seated position or even upright.

However, in practicing these two disciplines, certain conditions are required: it is not possible to practice these sports on any water surface or site, or under all weather conditions. Surfing and bodyboarding are done on surf sites: beaches receiving large or small waves with an appropriate profile. Furthermore, surfers do not necessarily appreciate wind: indeed, it makes the waves "choppy", "soft" and quite often unusable for surfing. However, if there are no sufficient waves, there is no sport. The surfer may wait for hours for a wave to experience several seconds to several minutes of sensation. He is never certain whether it will be possible to practice the sport. Furthermore, surfing and bodyboarding require intensive training and experience to achieve mastery. These disciplines are thus not accessible to everyone, and beginners quite often have trouble feeling or assessing the sensations until they have mastered their minimum technique.

In order to eliminate the need to perform surfing or bodyboarding on surf-dedicated sites and to thus be able to take advantage of equivalent sensations without depending on weather conditions, on-demand thrill seekers engage in wakeboarding. Like bodyboarding and surfing, wakeboarding is a gliding sport requiring the use of a board. However, it is based on a different principle: the athlete, more commonly called "rider", is pulled by a boat using a rope provided with a tow bar. A wave is created by the wake from said boat, and the rider takes advantage of that wave to jump on either side of said wake and perform different figures, such as, by way of non-limiting examples, backflips, rotations and grabs, figures inspired by "traditional" gliding sports, such as surfing or snowboarding. The rider uses a board providing good lift: fastened on this board are two shoes for the feet in the direction of the length, like for a snowboard. The choice of the board is determined by the style of the rider. Although this discipline makes it possible to do away with the location constraint, it raises other drawbacks: the position that the rider adopts on the board is sometimes not optimal because it may cause problems of knee pain and/or back pain and rapid fatigue. Furthermore, the means necessary for wakeboarding are not very accessible. Indeed, wakeboarding requires the presence of a specific boat, specially adapted to this sport: aside from the presence of a tower making it possible to fasten the tow rope, such a boat is equipped with ballasts so that it can be made heavier, as well as a specially designed hull, to ultimately obtain a wake creating higher waves. As a result, the boats are complicated to handle and require the presence of a dedicated staff, but also create very high costs due to their high degree of technicality.

Alternatively, some surfboards have been subject to improvements to offset difficulties related to weather conditions, in particular the presence or absence of waves, or those related to the return to port: they are better known as motorized surfboards. Thus, a motorized surfboard as described in document U.S. Pat. No. 6,192,817 B1 includes a body in the form of a board defining a stern and a bow, within which an internal combustion engine is housed, closer to the stern than the bow. Such a motor includes a flywheel attached to a crank and an outlet port and it is connected to a pump receiving the thrust created by the motor. Advantageously, said motorized board includes a wired controller to act on the acceleration and/or speed of the device. However, this type of device remains highly confidential, due to the many drawbacks that it raises, such as poor drivability, heaviness, excessive purchase and maintenance costs, large bulk, weak sensations, in particular in light of the use of a vehicle with a conventional motor, etc.

Furthermore, for each of the aforementioned activities, specific equipment is necessary. As an example, to surf, it is essential to have a surfboard, whereas for bodyboarding, it is essential to do so on a bodyboard adapted to that sport: it is often difficult to use a surfboard while remaining elongated. The same is true for motorized boards. Each piece of equipment is thus adapted and dedicated to each discipline. A multidisciplinary athlete must therefore invest in different equipment items.

To procure certain sensations, minimize intensive training and quite simply allow any person to move easily on the surface of a fluid, and more specifically of water, propulsion devices have been developed.

Thus, in the 60s, a propulsion device as described in documents U.S. Pat. Nos. 3,243,144 or 3,381,917 includes a body in the form of a harness or seat against or in which a passenger may be positioned, cooperating with a thrust unit in the form in particular of a pair of nozzles for ejecting a pressurized fluid and exerting thrust force. The nozzles are advantageously arranged above the center of gravity, at the height of passenger's shoulders. The thrust unit further includes a compression station for a fluid also positioned in the passenger's back supplied with gas or flammable liquids, also positioned in the passenger's back.

Given the dangerousness of this type of vehicle, more recently, other devices, inspired by teachings provided by the first invention, have been developed as described in documents U.S. Pat. No. 7,258,301 or US 2008/0014811. The compression station is now remote and generally dedicated. Furthermore, the pressurized fluid is water compressed by said station, said water being conveyed from a remote compression station using a supply pipe such as a fire hose. The configuration of the nozzles and the means making it possible to direct said nozzles are voluntarily retained. In addition to having a high cost, this device has other drawbacks as well: the configuration of the nozzles situated above the center of gravity gives the passenger the impression of being suspended from the shoulders by a virtual crane hook and thus deprives the latter of many sensations. Furthermore, the variety of directions and movements is limited.

FIG. 1 shows another embodiment of a propulsion device 10, said device having been designed by the builder ZAPATA RACING, as described in documents U.S. Pat. Nos. 8,336,805 or 8,608,104. This device includes a main body in the form of a substantially planar platform 11 on which a passenger 1 may be positioned. The propulsion device, described in connection with FIG. 1, includes a thrust unit cooperating with the platform 11. Such a thrust unit consists of a pair of primary nozzles 12*a* and 12*b* secured against the lower face of the platform 11. According to FIG. 1, the thrust unit of such a device may further include two secondary nozzles 13*a* and 13*b* to facilitate its maneuverability. The latter are free and intended to optionally and respectively be held by a passenger 1 at the forearms or hands. To deliver sufficient thrust force and allow take off, then movement, the device 10 further includes means for collecting and distributing a pressurized fluid, for example water, to the primary and secondary nozzles. Such a fluid is preferably conveyed using a flexible supply conduit 2 from a remote compression station, not shown in FIG. 1. Such a supply conduit can be made from a fire hose or any other materials having the necessary resistance to the pressure exerted by the pressurized fluid. A collector 14 can thus have a base 14*c* to which an end-piece 2*a* of a supply conduit 2 is attached, for example using a spline suitable for receiving said conduit 2. According to FIG. 1, the collector 14 may have a shape close to a "Y" to collect the pressurized fluid from the base 14*c* and distribute it via arms to the primary nozzles 12*a* and 12*b*, respectively. The collector 14 is connected to the primary nozzles or via an optional elbow 15, so as to direct the primary nozzles along an axis substantially perpendicular to the lower face of the platform 11. The arms are connected to said primary nozzles—via said elbow 15—by a pivot link at the arms. Such an arrangement allows a free rotation along an axis F substantially parallel to the arms of the collector 14. Thus, said collector can describe a quasi-free rotation r1 around said axis F, modulo the stop represented by the lower face 11*b* of the platform 11 when the latter has an excessive incline. Furthermore, such a pivot link allows the user to "take off" easily from the surface of the water and gives him a high orientation and movement capacity. A relative rotation r1 of the collector around the axis F with respect to the plane of the lower face of the platform 11, this rotation ensuing the link of the collector with the supply conduit 2, does not cause rotation of the platform 11. The end-piece 2*a* of the supply conduit 2 can advantageously cooperate with the collector 14 at its base 14 via a pivot link to allow a free rotation r2 around an axis C substantially parallel to the conduit 2. The device can thus pivot freely around said axis C without creating loops or excessive stresses on the supply conduit 2.

To distribute the pressurized fluid to the secondary nozzles 13*a* and 13*b*, as an example and as shown in FIG. 1, secondary conduits 18*a* and 18*b*—advantageously in the form of flexible hoses—can be provided to deliver said pressurized fluid from the collector 14 to the secondary nozzles. So as not to bother the passenger 1, said secondary conduits can be guided along the back to the shoulders through the use of maintaining means 19, such as straps, harnesses, etc. The passenger may further use means to restrain that the secondary nozzles at his forearms.

The platform 11 may have means for maintaining a passenger on the upper face of said platform 11. Thus, depending on the preferred position of a passenger on the platform, said maintaining means may consist—as indicated in FIG. 1—of a pair of slippers, foot straps or fastening boots 16 of a type similar to those for example found in wakeboarding.

A propulsion device, for example like the device 10 described in connection with FIG. 1, can be supplied by any fluid compression station inasmuch as the latter is able to deliver a fluid having a sufficient pressure to ensure the operation of the propulsion device. The latter may be remote and dedicated to that use, at the risk of increasing the overall cost of a propulsion system including a propulsion device, a compression station and a supply conduit cooperating with said device and station to convey the pressurized fluid. Such a station may alternatively consist of using an adapted motorized water vehicle (MWV) as described in document WO2013/041787A1, to cut costs.

FIG. 1 preferably describes a system in which the fluid used is pressurized water to move on the surface of a body of water. Although the propulsion device described in relation with FIG. 1 makes it possible to move easily in and/or on the surface of the water and offers its user large degrees of freedom to perform a large number of figures, it may have drawbacks for some. First of all, the configuration of the nozzles below the platform favors a substantially vertical movement and does not allow a rapid movement substantially parallel to the surface of the water: the speed of movement is thus limited, restricting the sensations of the performance-seeking passenger. Additionally, when a passenger, positioned on the platform, wishes to move along the surface of the water, this requires additional effort on his part, since the configuration of the nozzles below the platform drives a vertical movement. As a result, the balanced position to achieve the desired movement is often difficult to maintain and tiring.

The invention makes it possible to resolve the large majority of the drawbacks raised by the known solutions.

Among the many advantages provided by a device according to the invention, it can be mentioned that the latter makes it possible to: provide users with a highly entertaining device which, after a quick learning process, is easy to use and offers a wide variety of applications; provide an "all-in-one" device, making it possible, using a single adaptable device, to perform different activities without even having to leave the vehicle; be able to take off or dive irrespective of the weather conditions, completely or partially submerged, from solid land, etc.; decrease the fatigue of a passenger wishing to move substantially parallel to the surface of the fluid; increase the horizontal movement speed during the use of the propulsion device; limit or even eliminate any stresses related to practicing a water sport very close to surfing, such a sport being able to be done on any water surface irrespective of the weather.

To that end, in particular provided is a propulsion device, including a platform on which a passenger is positioned, said platform comprising an upper surface and a lower surface, and cooperating with means for collecting and distributing a pressurized fluid to a primary nozzle expelling said fluid from a fluid outlet in a given direction, said means being supplied with pressurized fluid by a fluid supply conduit.

To increase the movement speed, increase ergonomics, decrease fatigue stresses for the passenger positioned on the platform and facilitate movement substantially parallel to the surface of the water, the primary nozzle is oriented substantially from the bow to the stern of the platform. Furthermore, the fluid expulsion direction fits in a median plane of the platform. Additionally, it describes an angle comprised between −10° and +45° with a longitudinal axis of the platform contained in said median plane. Lastly, the fluid collecting and distributing means cooperate with the platform by an embedding link.

To decrease the stresses of the fluid supply conduit in rotation relative to the platform and thereby guarantee greater freedom of movements, the means for collecting and distributing a fluid may cooperate with the fluid supply conduit using a pivot link at the proximal part of said conduit.

In order to allow greater freedom of movement and more complex figures for a passenger, the platform may include at least two parts forming a single and same entity.

Alternatively, the primary nozzle may cooperate with the upper surface of the platform, the fluid expulsion direction of said nozzle and a longitudinal axis of the platform, said direction and longitudinal axis being comprised in a median plane and substantially parallel.

In order to adjust the position of the primary nozzle on the platform, the propulsion device may include means for adjusting the distance between the primary nozzle and the bow of the platform along a longitudinal axis of said platform.

Alternatively, or additionally, so as to perform sharp tight turns and easier directional movements, the propulsion device may include two co-planar secondary nozzles cooperating with the lower face of the platform in a plane secant to a longitudinal plane of the platform along a transverse axis of the platform, the normals of said planes describing an angle comprised between 0° and 90°.

Preferably, the fluid expulsion directions of the secondary nozzles can describe an angle comprised between 60° and 120° relative to one another.

In order to guarantee optimal efficacy of the device according to the invention while optimizing manufacturing costs, the primary nozzle and the two secondary nozzles can constitute a single and same entity in the form of a "composite" fluid outlet.

To allow faster movement when the passenger moves in a straight line parallel to the surface of the fluid, the propulsion device may include means for independently closing off the fluid outlets of each secondary nozzle.

Advantageously, the closing off means can be controlled electrically, hydraulically or pneumatically.

To allow an appropriate adjustment of the speed, the propulsion device may advantageously include means for adjusting the angle $\alpha$ described by the fluid expulsion direction and the longitudinal axis contained in the median plane containing said fluid expulsion direction.

In order to facilitate the adjustment of the angle described by the fluid expulsion direction of the primary nozzle and said longitudinal axis, the adjusting means can be controlled electrically, hydraulically or pneumatically.

To perform tight and sharp turns, the adjusting means may consist of a directional fluid outlet.

Preferably, the directional fluid outlet can be able to be oriented along a median plane, said median plane containing the fluid expulsion direction.

Alternatively, to decrease the pressure losses in the collecting and distributing means and thus boost the performance of the device for a same compression power, at least part of the means for collecting and distributing the pressurized fluid and the primary nozzle can include an oblong section.

Additionally, the fluid outlet of the primary nozzle can cooperate with a flap. Preferably, the flap is articulated.

In order to ensure greater freedom and movement possibilities, the propulsion device may advantageously include at least two primary nozzles whereof the respective fluid expulsion directions are substantially parallel to one another.

Advantageously, to allow joint use of the primary nozzles, the means for collecting and distributing a fluid can be arranged to distribute the fluid to the different primary nozzles.

To protect the nozzle(s) and all or part of the means for collecting and distributing the pressurized fluid, the propulsion device may include a fairing cooperating with the platform.

Advantageously, the propulsion device may include means for ensuring the maintenance of a passenger on the platform.

When the passenger is in the elongated position, the means for maintaining a passenger may include gripping means.

Alternatively, or additionally, the means for maintaining a passenger may include bearing means.

A second object of the invention relates to a propulsion system. Advantageously, it includes a propulsion device according to the invention cooperating with a remote compression station, said station supplying pressurized fluid to said device.

Furthermore, the propulsion system according to the invention may include a supply conduit connected on the one hand to the device and on the other hand to the remote compression station so that the latter delivers the pressurized fluid to said device via said supply conduit.

Preferably, in order to facilitate the delivery of the pressurized fluid, the remote compression station consists of a personal watercraft including a hull, propulsion means compressing, by turbining, a fluid entered through an inlet and expelling said fluid thus pressurized from a fluid outlet of said vehicle.

SUMMARY OF THE INVENTION

An example of the present invention advantageously provides a propulsion device, including a platform on which a passenger is positioned, said platform comprising an upper surface and a lower surface, and cooperating with means for collecting and distributing a pressurized fluid to a primary nozzle expelling said fluid from a fluid outlet in a given direction, said means being supplied with pressurized fluid by a fluid supply conduit, the device being characterized in that: the primary nozzle is oriented substantially from the bow to the stern of the platform; the fluid expulsion direction fits in a median plane of the platform; the fluid expulsion direction of the primary nozzle describes an angle comprised between −10° and +45° with a longitudinal axis of the platform contained in said median plane; the means for collecting and distributing a fluid cooperate with the platform by an embedding link. The means for collecting and distributing a fluid may cooperate with the fluid supply conduit using a pivot link at the proximal part of said conduit. The platform may include at least two parts consisting of a single and same entity. The primary nozzle may cooperate with the upper surface of the platform, the fluid expulsion direction of said nozzle and a longitudinal axis, said fluid expulsion and longitudinal axis directions being comprised in a median plane and substantially parallel. The propulsion device may include means for adjusting the distance between the primary nozzle and the bow of the platform along a longitudinal axis of said platform.

The propulsion device may include two co-planar secondary nozzles cooperating with the lower face of the platform in a plane secant to a longitudinal plane of the platform along a transverse axis of the platform, the normals of said planes describing an angle comprised between 0° and 90°. The fluid expulsion directions of the secondary nozzles may define an angle β comprised between 60° and 120° relative to one another. The primary nozzle and the two secondary nozzles may constitute a single and same entity in the form of a "composite" fluid outlet. The propulsion device may include means for independently closing off the fluid outlets of each secondary nozzle. The closing off means may be controlled electrically, hydraulically or pneumatically. The propulsion device may include means for adjusting the angle α described or defined by the fluid expulsion direction of the primary nozzle and a longitudinal axis contained in the median plane containing said fluid expulsion direction. The adjusting means may be controlled electrically, hydraulically or pneumatically, and/or may consist of a directional fluid outlet. The directional fluid outlet can be oriented along a median plane, said median plane containing the fluid expulsion direction. At least part of the means for collecting and distributing the pressurized fluid and the primary nozzle may include an oblong section. The means for collecting and distributing the fluid may include a connecting elbow. The fluid outlet of the primary nozzle may cooperate with a directional flap. The directional flap may be articulated along a median plane of the platform.

The propulsion device may include at least two primary nozzles whereof the respective fluid expulsion directions are substantially parallel to one another. The means for collecting and distributing a fluid may be arranged to distribute the fluid to the different primary nozzles. The propulsion device may include a fairing cooperating with the platform. The propulsion device may include means for ensuring the maintenance of a passenger on the platform. The means for maintaining a passenger may include gripping means and/or bearing means.

An example of the present invention advantageously provides a propulsion system, characterized in that it includes a propulsion device according to any of the above cooperating with a remote compression station, said station supplying pressurized fluid to said device. The propulsion system may include a supply conduit connected on the one hand to the device and on the other hand to the remote compression station so that the latter delivers the pressurized fluid to said device via said supply conduit. The remote compression station may include a motorized water vehicle including a hull, propulsion means compressing, by turbining, a fluid ingested from an inlet and expelling said fluid thus pressurized from a fluid outlet at the rear of said vehicle.

Another example of the present invention advantageously provides propulsion device, comprising a platform defining an upper surface, a lower surface, a bow, and a stern, wherein the platform defines a longitudinal axis extending form the bow to the stern; a fluid collector coupled to the lower surface of the platform; a flexible fluid supply conduit coupled to the fluid collector; and a primary nozzle in fluid communication with the fluid collector and configured to expel a fluid towards the stern, wherein the primary nozzle is oriented substantially parallel with the longitudinal axis in a first plane, and defines an angle α between −10° and +45° with the longitudinal axis in a second plane. The fluid collector may be pivotable with respect to the supply conduit. The platform may include a plurality of surface segments coupled to one another to form the upper and lower surfaces. The distance between the primary nozzle and the bow of the platform may be selectively adjustable. The propulsion device may include two or more co-planar secondary nozzles coupled to the lower surface of the platform, where the secondary nozzles may define an angle β between each other that is between 60° and 120°. The primary nozzle and the secondary nozzles may constitute or be defined by a single fluid manifold. Fluid flow through each of the secondary nozzles may be selectively adjustable, and may be selectively adjustable through operation of at least one of an electrical, hydraulic or pneumatic actuator. The angle α may be selectively adjustable and may be selectively adjustable through operation of at least one of an electrical, hydraulic or pneumatic actuator. The propulsion device may include a directional fluid outlet movably coupled to the primary nozzle. The directional fluid outlet may be selectively adjustable through operation of at least one of an electrical, hydraulic or pneumatic actuator. The propulsion device may include a directional flap coupled to the primary nozzle, and the directional flap may be movable about the primary nozzle. The propulsion device may include bindings configured to secure a passenger's feet to the upper surface of the platform. The propulsion device may include a remote compression station supplying pressurized fluid to the flexible supply conduit, where the remote compression station may include a motorized water vehicle.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein:

FIGS. 2*a* and 2*b* respectively describe two use configurations of a propulsion device according to the invention;

DETAILED DESCRIPTION OF THE INVENTION

Figure 1:
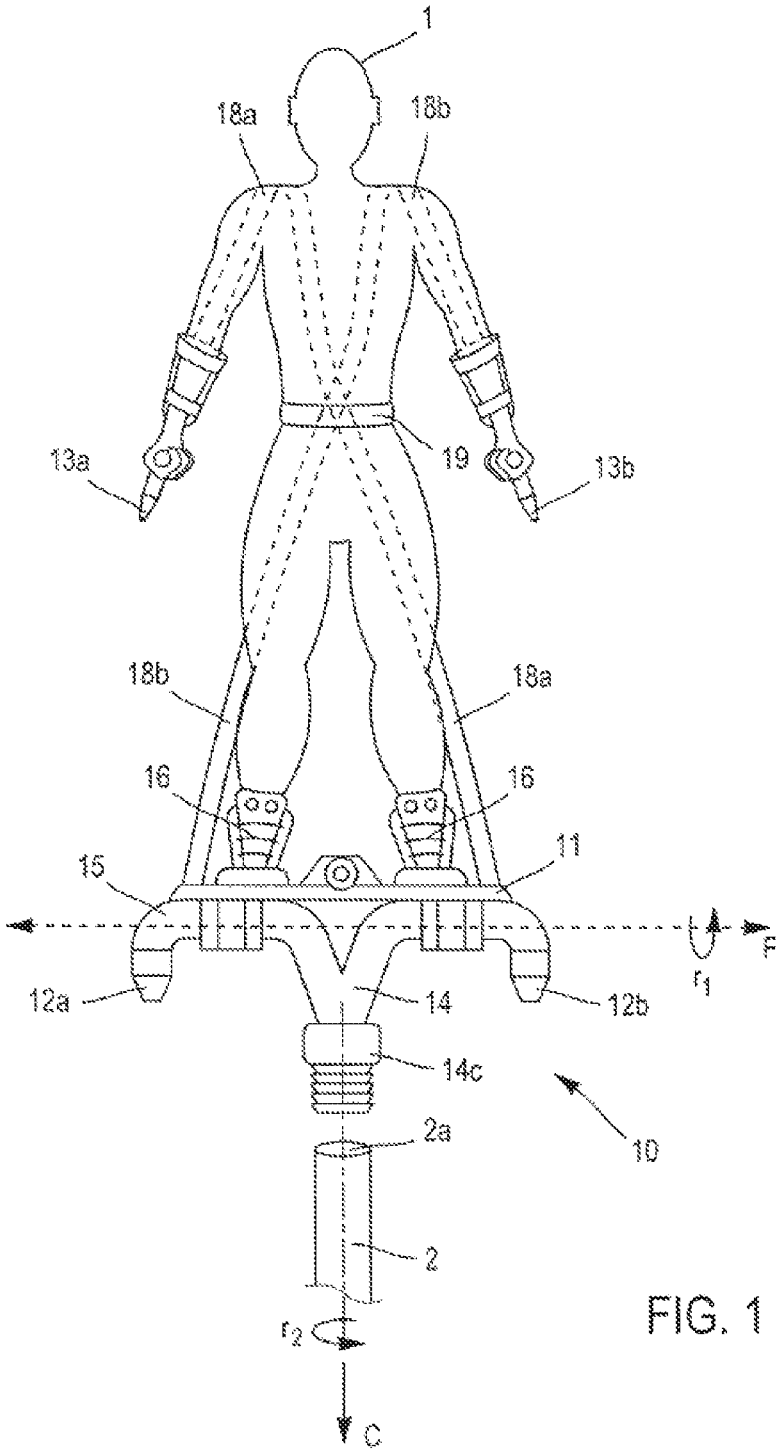
FIG. 1, previously described, illustrates an embodiment of a propulsion device known from documents U.S. Pat. Nos. 8,336,805 or 8,608,104.

According to a first embodiment of a propulsion device 20 according to the invention, described in connection with FIGS. 3*a*, 3*b* and 3*c*, such a device includes a main body in the form of a platform 21, on which a passenger 1 can be positioned. Depending on the size of the platform and the power of the remote compression station, the invention provides that several passengers may optionally be positioned simultaneously on said platform 21. The platform includes a lower surface 21*i* and an upper surface 21*s*. The passenger(s) 1 may be located on one or the other of the lower 21*i* or upper 21*s* surfaces, depending on the type of sensations they wish to feel or the activity that the passenger(s) 1 wish to engage in: the device and/or the platform will advantageously be qualified as "reversible". Furthermore, the platform may advantageously be made from one or several materials having, alone or in combination, a sufficient rigidity to bear the weight of one or more passengers and thus avoid any excessive deformation. Alternatively, or additionally, according to FIG. 6, the device may advantageously include one, or in some cases several, arm(s) 42 or reinforcing bar(s), advantageously cooperating with the platform 21 and preferably secured using any means to the lower surface of said platform 21*i*. Such a reinforcing arm 42 is sized as follows: the distal end of said arm 42 cooperates with said platform 21 along a zone of the lower surface 21*i* located in the first third of said surface from the bow; furthermore, the proximal end of said arm cooperates by any means with the stern of the device 20 according to the invention, i.e., the platform 21 and/or the thrust unit. Indeed, the passenger 1 positions his front foot, advantageously but non-limitingly, at a distance of two thirds of the platform 21 from the stern. The presence of such an arm makes it possible to greatly decrease the dimensions of the platform 21, in particular its thickness and its width, since the arm(s) damp the flexion of the platform 21. A component material of said platform 21 may be favored to act on the buoyancy of the device when the latter is submerged. According to the embodiments, the platform can thus have one or several cavities filled with air or a vacuum to improve the buoyancy. Alternatively, it is possible to favor the absence of vacuum or cavity, or even the presence of a counterweight or ballast, advantageously able to be emptied, to facilitate movement below the surface of a fluid. Such emptying may for example make it possible to recover the gliding activity, when a passenger 1 wishes to move on the surface of a fluid. Preferably, the platform 21 can be made in a single and same part, such as, by way of non-limiting examples, a surfboard, bodyboard or wakeboard. However, the platform 21 may advantageously be made up of at least two parts, together forming a single and same entity, to impart a certain flexibility to the device and thus impart greater freedom and originality in terms of the figures or movements.

Alternatively, or additionally, the platform may advantageously have a curve or rocker (not shown in FIGS. 3*a* to 3*d*, 4 to 6), said curve being observed along a profile view, starting from the bow of the platform 21 toward the stern, like the boards traditionally used in surfing, bodyboarding or wakeboarding. Different types of rockers exist depending on the desired use of the device 20 according to the invention: a stretched rocker, in other words substantially flat, favors speed and tight turns, while a so-called "banana" curve, i.e., the curve having a greater curve angle, favors the maneuverability and reaction sharpness of the platform 21. The presence of a curve, in the elongated position, allows a passenger 1 to remain on the platform, in place of adapted maintaining means. Furthermore, it is provided that the curve may be adjustable and/or configurable depending on whether the passenger 1 wishes to favor speed or maneuverability of the device 20 according to the invention. Furthermore, the curve may be reversible, such that the curve plays a role in stabilizing the pitch when the device according to the invention moves in an "underwater" configuration, i.e., the lower surface of the platform 21 being above the upper surface, said passenger being positioned on said lower surface.

Figure 3A:
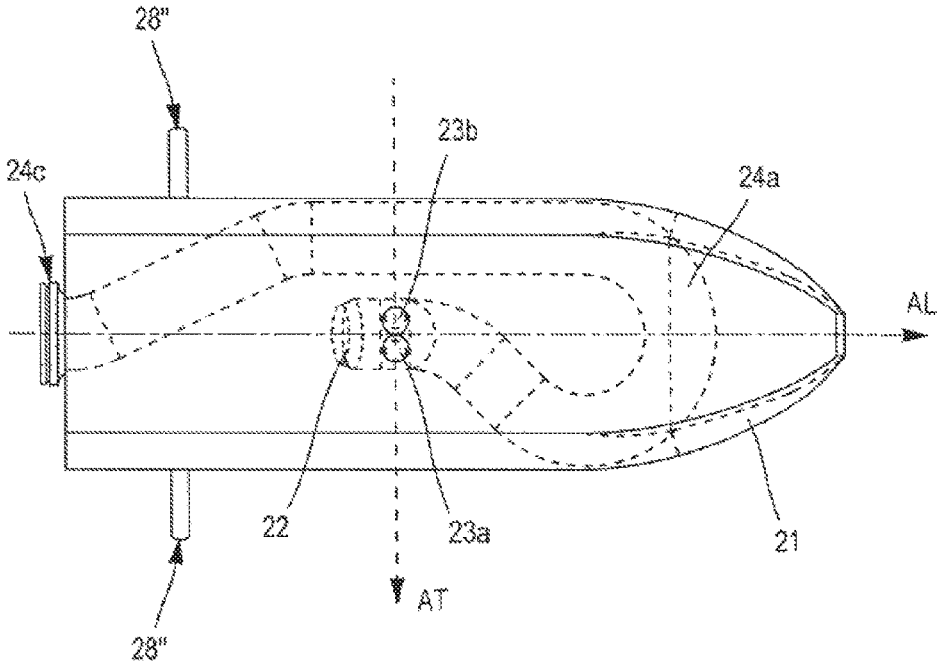
FIGS. 3*a*, 3*b* and 3*c* show sectional views of a first embodiment of a propulsion device according to the invention.
Figure 3B:
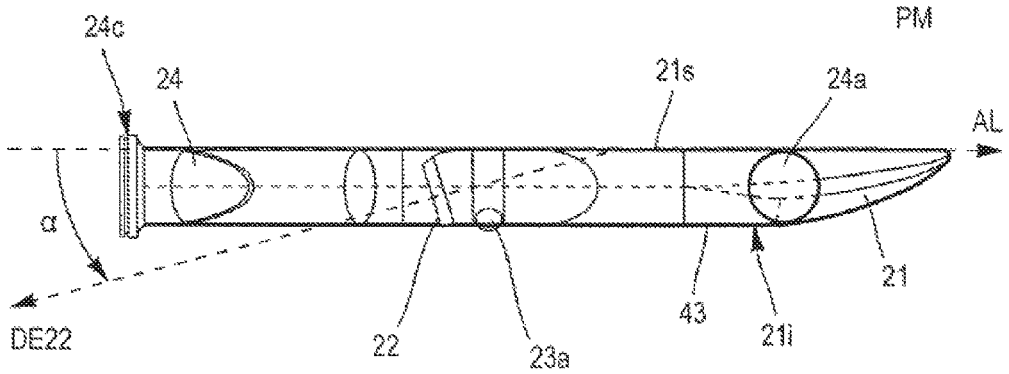
Figure 3C:
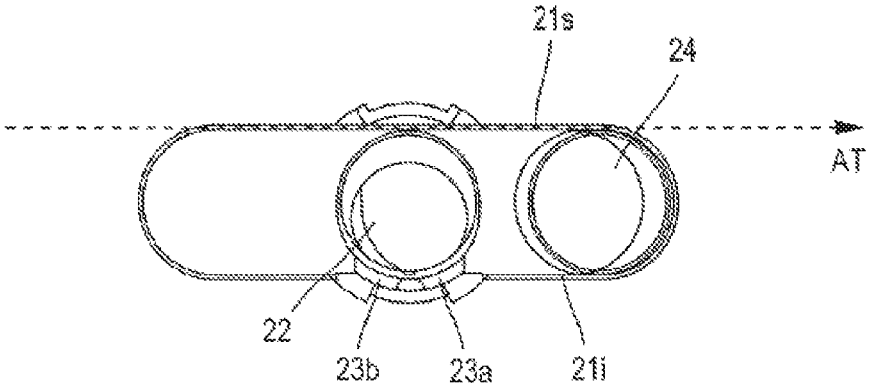
Figure 4:
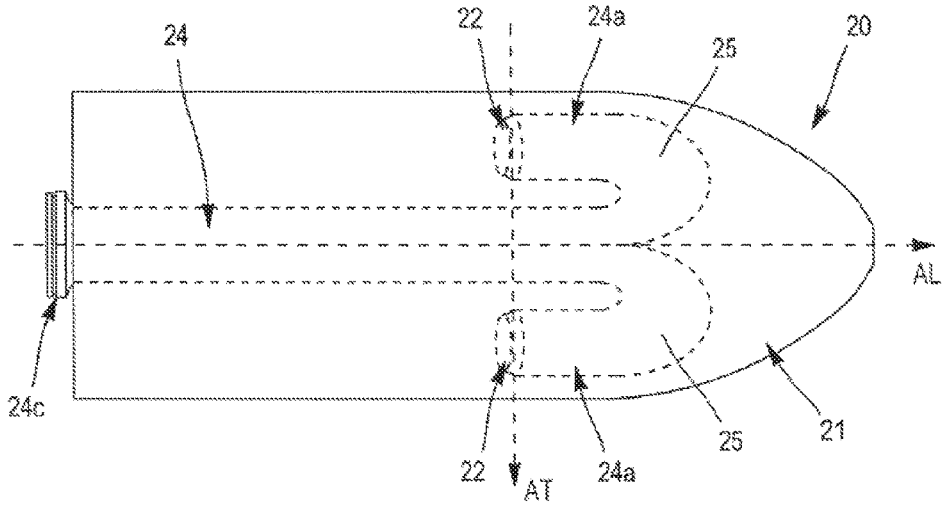
FIG. 4 describes a second embodiment of a propulsion device according to the invention.

A propulsion device 20, described in connection with FIGS. 2*a* and 2*b*, FIGS. 3*a*, 3*b* and 3*c*, or even in alternatives according to FIGS. 4, 5 and 6, includes a thrust unit cooperating with the platform 21.

In the present document, we use the term "nozzle" to define a profiled channeling element, intended to impose an increase in speed on a fluid flow. We could also use the term "tip" to characterize such an element. This speed increase of the fluid is primarily due to a difference in section between the inlet and the outlet of the element, the section of the outlet being smaller than that of the inlet.

Such a thrust unit consists of a primary nozzle 22 cooperating with the upper surface 21*s* or lower surface 21*i* of the platform 21. Such a primary nozzle 22 performs the propulsion function. According to FIGS. 2 and 2*b*, 3*a*, 3*b* and 3*c*, the primary nozzle 22 is secured against the lower face 21*i* of the platform and oriented from the bow, i.e., the front, toward the stern, i.e., the rear, of said platform 21: such an orientation advantageously contributes to the movement substantially parallel to the surface of the fluid above or below which the propulsion device according to the invention moves. Alternatively, as described in connection with FIG. 4, two primary nozzles 22 may be secured on the lower face 21*i* of the platform, said nozzles all being oriented from the bow toward the stern of the platform 21. Advantageously, when there are two nozzles, the fluid expulsion directions are substantially parallel in order to ensure an optimal and fast movement of a propulsion device 20 according to the invention. It is thus possible to increase the entertaining nature of the use of the device by a passenger. In general, the invention is not limited to the number of primary nozzles located below the lower face 21*i* of the platform 21. The thrust unit thus includes at least one primary nozzle 22 cooperating with said lower face. Similarly, such a primary nozzle 22 can also cooperate with the upper surface 21*s* of a platform 21*s*.

Said primary nozzle 22 is secured to the platform using any means via an embedded link. Such an embedded link means that the primary nozzle 22 is completely attached to the platform 21 and that no relative movement is possible between said primary nozzle 22 and platform 21. According to one preferred alternative, the primary nozzle 22 can be mounted moving relative to the platform 21. To favor the takeoff of the device and subsequently guarantee its movement in a direction substantially parallel to the surface of a fluid, any primary nozzle 22 is oriented from the bow toward the stern of the platform 21 such that such a primary nozzle 22 expels a pressurized fluid from the bow of the platform 21 toward the stern thereof in a direction DE22. Furthermore, the fluid is expelled in a median plane at the platform. In connection with FIG. 6, median, transverse and longitudinal planes are defined, as well as longitudinal and transverse axes. These terms are defined as follows:

"median plane" PM, any plane normal to the platform 21, which separates the port side from the starboard side of said platform 21, said halves not necessarily being equal;

"transverse plane" PT, any plane normal to a median plane, which separates the platform 21 into two halves, one including the bow of said platform 21 and the other including the stern of the latter, said halves not necessarily being equal;

"longitudinal plane" PL, any plane normal to transverse and median planes, said plane separating an upper half from a lower half of the platform 21, said halves not necessarily being equal;

"transverse axis" AT, any axis belonging both to a transverse plane and longitudinal planes; and "longitudinal axis" AL, any axis belonging both to a median plane and a longitudinal plane.

According to FIGS. 3*a*, 3*b*, 5 and 6, the outlet direction of the fluid from a primary nozzle 22 is located in a median plane PM, said median plane PM comprising a longitudinal axis AL. The fluid is thus expelled from the primary nozzle 22 with an angle α. The angle α, described between the fluid expulsion direction DE22 and the longitudinal axis AL, is advantageously comprised between −10° and +45° so as to ensure a rapid optimal movement as close as possible to the fluid surface and to allow total use freedom of the platform. The value of the angle α is substantially zero, when the fluid outlet direction is substantially combined with the longitudinal axis AL. Indeed, as previously specified, a propulsion device according to the invention is "reversible", i.e., the fluid expulsion direction makes it possible not only to move in the air around the water by advantageously adjusting said angle α comprised between 0° and +45°, but also beneath the water like a "submarine" by advantageously adjusting said angle α comprised between −10° and 0°.

The angle α can advantageously be adjusted: this adjustment may depend, as non-limiting examples, on the weight of the passenger, the power of the compression station, or quite simply, as previously specified, the movement that the passenger 1 wishes to perform. The primary nozzle 22 can advantageously be secured on a base (not shown in the figures), the latter having indentations to allow the adjustment of the angle α: such an arrangement is comparable to a so-called ratchet mechanism. Alternatively, one or several external flaps, optionally steerable, or a steerable fluid nozzle or outlet, said flaps and elbow advantageously being able to be oriented along a median plane, can also be considered. Such flaps and nozzle will be described more precisely below.

Furthermore, different adjustment routes may be used:

first of all, through the static route, also called "manual", before any use of the propulsion device 20, the passenger 1 can manually adjust the angle α by moving or orienting the primary nozzle 22, in particular the fluid outlet direction;

next, dynamically, before any use or during the use of the propulsion device 20, the passenger 1 can adjust the angle α using control or input interface means, such as, by way of non-limiting example, a wired or wireless remote control that the passenger 1 can hold in his hand or that can be positioned on the platform 21;

lastly, automatically, during the use of the propulsion device 20, the angle α can be adjusted directly thanks to the use of one or several inclinometers that measure the pitch of a longitudinal plane PL of the platform 21 and the measurements of which are used by an onboard calculator in the device that determines and controls the appropriate angle α depending on the movements made by the passenger 1. A device according to the invention may further, or alternatively, include one or several other sensors to measure, for example, the acceleration of the device and thus allow said calculator to adjust the angle α. As a non-limiting example, when the platform 21 is substantially horizontal, the calculator may advantageously determine an angle α with a low value to maximize the movement speed of the device. Alternatively, for a non-horizontal pitch, such a calculator may command actuators to increase the angle α to be sharper and to slalom more easily. The orientation of the fluid outlet of a primary nozzle 22 can thus be determined, pre-adjusted or adjusted dynamically, humanly or automatically according to the alternative embodiments of a device according to the invention.

Figure 5:
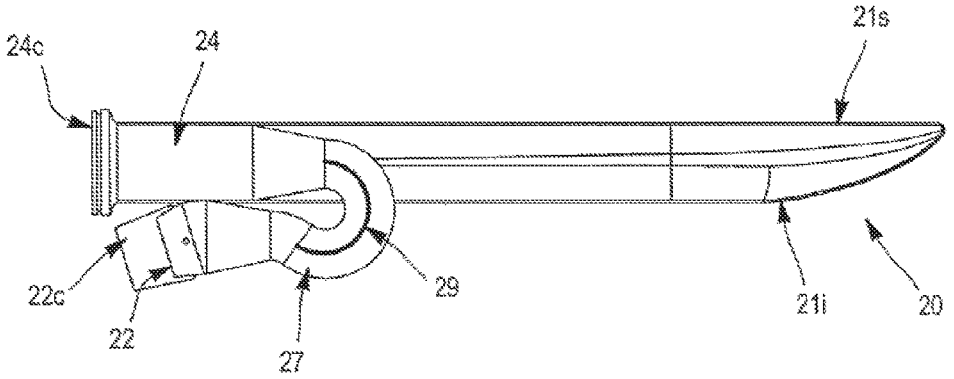
FIG. 5 illustrates a third embodiment of a propulsion device according to the invention.
Figure 6:
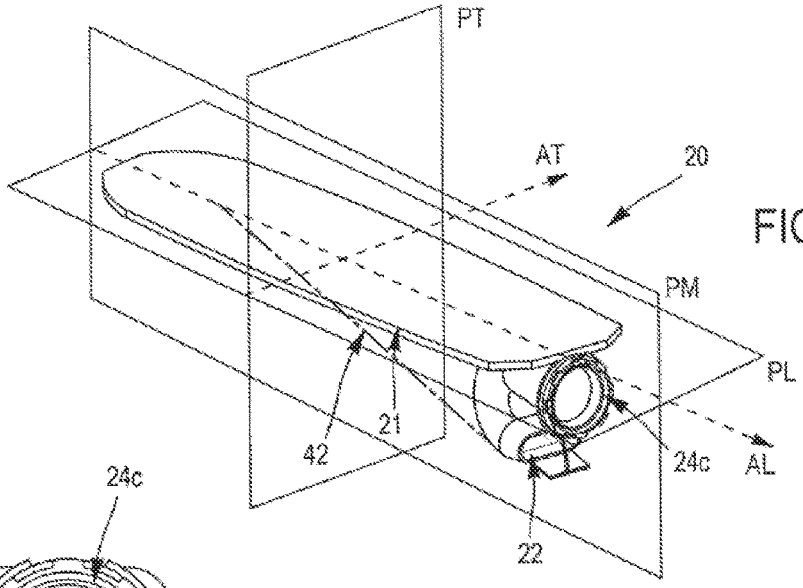
FIG. 6 describes a three-quarters view of the third embodiment of a propulsion device according to the invention, specifying the notions of longitudinal, transverse, median planes, as well as transverse and longitudinal axes of the platform used in the present document.

Furthermore, according to FIG. 5, the means for adjusting the angle α can consist of a directional fluid outlet 22*c*, in order to orient the expulsion of the fluid. These means for adjusting the angle α can advantageously, but non-limitingly, consist of a directional nozzle, adaptable on the fluid outlet of the primary nozzle 22. Such a nozzle may for example be inserted on the fluid outlet of the primary nozzle 22. Preferably, said directional nozzle can be oriented in a median plane PM of the platform 21 relative to a longitudinal axis AL comprised in said median plane PM.

Lastly, it is also possible to adjust the position of the primary nozzle 22 in the median plane PM, along the longitudinal axis AL, by adjusting the distance between said primary nozzle 22 and the bow of the platform 21. Such means for adjusting the distance may, advantageously but non-limitingly, be an adjusting rail positioned securely on the lower face of the platform 21. Said position of the primary nozzle 22 may affect the angle α: indeed, the larger the distance is between the primary nozzle and the bow of the platform 21, the larger the angle α must be. Indeed, the angle α counterbalances the weight of a passenger 1 and the position that he assumes on the platform 1. The positioning of a primary nozzle in light of the bow and/or the angle α can be determined dynamically by a calculator onboard a device according to the invention that would use, as previously mentioned, measurements from sensors positioned on the device, to translate an incline of a longitudinal, median or transverse plane and/or acceleration of said device into a control of the actuators to adjust the angle α.

Furthermore, the thrust unit of a propulsion device according to the invention may include two secondary nozzles 23*a* and 23*b* to facilitate the maneuverability of the device 20, in particular during sequences of figures in tight turns, and consequently to maximize sensations. The two secondary nozzles 23*a* and 23*b* fit in a same plane, secant to a longitudinal plane along a transverse axis and normal to any median plane, so as to guarantee, during turns to the left or right, a same gesture for the passenger: one thus seeks to provide a device 20 according to the invention that is intuitive, so that such a device can be used by a large number of different users, irrespective of their levels. Said secondary nozzles 23*a* and 23*b* are secured to the platform 21 using any means via an embedding link, i.e., they are completely attached to the platform 21, they do not have any degree of freedom and no relative movement between the platform 21 and the secondary nozzles 23*a* and 23*b* is possible. According to one preferred alternative, the primary nozzles 23*a* and 23*b* can be mounted movably with respect to the platform 21. They cooperate with the lower face 21*i* in a plane PS secant to a longitudinal plane of the platform 21 along a transverse axis. As a reminder, "transverse axis" refers to any axis belonging both to a transverse plane PT and a longitudinal plane PL.

Figure 3D:
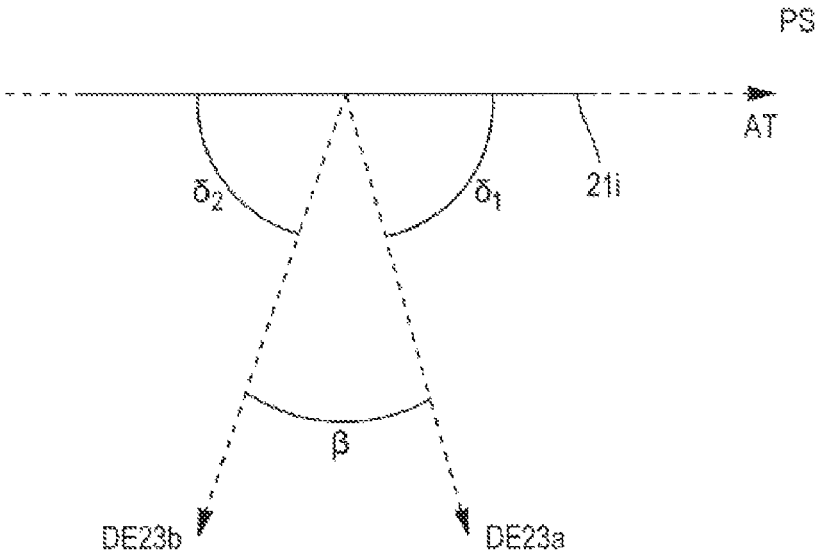
FIG. 3*d* illustrates a simplified diagram of the first embodiment of a propulsion device according to the invention.

According to FIG. 3*d*, said FIG. 3*d* illustrating a simplified diagram describing a transverse axis AT of the platform 20 in a plane PS of the secondary nozzles 23*a* and 23*b*, said transverse axis corresponds to the axis AT. The normals of the plane PS and a longitudinal plane PL form an angle comprised between 0 and 90°, i.e., said secondary nozzles 23*a* and 23*b* can be oriented, like the primary nozzle 22, substantially from the bow toward the stern. When the angle between the normals is substantially equal to 0°, the fluid outlets of said secondary nozzles are oriented parallel to the longitudinal plane PL. Conversely, when the angle between the normals is substantially equal to 90°, the fluid outlets of the secondary nozzles are oriented in a transverse plane PT. Preferably, the angle formed between the two normals of the planes PS and PL can be comprised between 45° and 90°, to optimize the function of the secondary nozzles, i.e., to perform a "guide" role for the displacements and movements of the device 20 during tight turns by a passenger 1.

Furthermore, as specified in connection with FIG. 3*d*, said respective fluid outlets of the secondary nozzles are symmetrical relative to a median plane, the directions of said fluid outlets being mutually secant with said median plane PM. Said respective fluid outlet directions DE23*a* and DE23*b* of the secondary nozzles 23*a* and 23*b* describe a predetermined angle β. Preferably, such an angle β is comprised between 60 and 120°. These values are advantageously chosen to guarantee the lift of the device 20 according to the invention in turns, and thus optimal movements. Consequently, the complementary angles $\delta_1$ and $\delta_2$ in light of the transverse axis AT are preferably equal, their values depending on the movements or figures performed. For B equal to 120°, $\delta_1$ and $\delta_2$ are equal to 30°. The invention provides, however, that the values of $\delta_1$ and $\delta_2$ can be different. The nozzles 23*a* and 23*b* then remain coplanar, but their respective fluid outlet directions DE23*a* and DE23*b* do not have any symmetry. Similarly, to a primary nozzle, the relative angles β or $\delta_1$ and $\delta_2$, described by the secondary nozzles 23*a* and 23*b*, can be adjusted by different routes such as, for example but non-limitingly, static, dynamic or automatic routes.

Alternatively, or additionally, as illustrated in connection with FIGS. 3*a*, 3*b* and 3*c*, a primary nozzle 22 and two secondary nozzles 23*a* and 23*b* can constitute a single and same entity in the form of a "composite" fluid outlet. Such an arrangement not only makes it possible to optimize the manufacturing time and costs, but also to control mutual adjustments of the different fluid outlets of the respective nozzles very precisely. When such a configuration is favored and said composite fluid outlet is positioned at the center of the lower face 21*i* of the platform 21, the angle α is preferably comprised between +5 and +10°.

Lastly, the device 20 according to the invention may also include closing off means, not shown in FIGS. 3*a* to 3*d*, for closing off the fluid outlet of the secondary nozzles 23*a* and 23*b* independently. Such means make it possible to deliver the majority of the thrust force at the primary nozzle(s) 22 to the detriment of the secondary nozzles 23*a* and 23*b* and thus to favor the takeoff of a device 20 according to the invention, or to allow faster movements in a straight line. They can, as non-limiting examples, assume the form of flaps, stoppers or valves. Like the means for adjusting the angles α, β of the primary 22 or secondary 23*a* and 23*b* nozzles, the closing off means can be implemented in different ways: manually or statically before any use of the device 20, dynamically using a input interface such as a remote control before or after the use of the device 20, or automatically—via a closing off controls generated by a calculator onboard the propulsion device—during the use of the device 20 thanks to measurements delivered by incline or accelerator sensors of the platform 21, said closing off controls being delivered by a wired or contactless route to close off actuators such as flaps, valves for example. Advantageously, the adjusting means and the closing off means can be implemented similarly, as a non-limiting example, using a shared remote control and/or a shared calculator.

The "platform, thrust unit and passenger(s)" assembly has a center of gravity CG. Unlike certain propulsion devices known from the prior art, for which the nozzles of the thrust unit must be positioned above said center of gravity CG to minimize the physical effort from the passenger and simplify the movements thereof, the primary and secondary nozzles of the thrust unit of the device 20 according to the invention are positioned below said center of gravity CG. The agility of the passenger and his physical comfort thus maximize the procured sensations and allow all movements, all trajectories and all acrobatic figures, whether intentional or occurring by chance.

In order to deliver a sufficient thrust force and allow takeoff, then movement, the device 20 further includes means for collecting and distributing a pressurized fluid, for example water, to the primary 22 and secondary 23*a* and 23*b* nozzles. Such a fluid is preferably and previously conveyed using a flexible supply conduit 2 from a remote compression station (not shown in FIGS. 1 to 8*c*). Such a supply conduit 2 can be made from a material constituting a fire hose, for example leather, or any other materials having the necessary resistance to the pressure exerted by the pressurized fluid. Such a supply conduit 2 must have an appropriate diameter, such as, by means of non-limiting example, a conduit whose diameter in section is substantially equal to 110 mm. Nevertheless, a larger diameter may also be used, the device not being designed to move at a significant height relative to the surface of the fluid, the weight of the conduit not being critical, unlike with the supply of a device according to FIG. 1. An excessively small diameter would create significant pressure losses in light of the compression capacity of the remote compression station: thus, for a given compression capacity, the propulsion would no longer be adequate to guarantee the takeoff and movements of the device 20 according to the invention.

Such means for collecting and distributing a fluid can advantageously include a collector 24. Such a collector 24 can thus have a base 24*c* to which an end-piece 2*a* of a supply conduit 2 is attached, for example using a spline adapted to receive said conduit 2, optionally detachable by indexing. The diameter of said base 24*c* will be adapted to the diameter of the end-piece 2*a* of the supply conduit 2. According to FIGS. 3*a*, 4 to 6, the collector 24 can cooperate with the platform 21 via an embedding link: as a result, the collector 24 is rigidly secured and is attached to the platform in order to avoid any relative movement between the platform 21 and the collector 24 and, consequently, to benefit from the camber induced by the pressurized fluid to favor the lift of a device according to the invention and/or to compensate with the weight of a passenger 1. As illustrated in connection with FIGS. 2*a* and 2*b*, the invention provides that the end-piece 2*a* of the supply conduit 2 can advantageously cooperate with the base 24*c* of the collector 24 via a pivot link to allow a free rotation r2 around an axis C substantially parallel to the conduit 2. The device 20 can thus freely pivot around the axis C without creating loops or excessive stresses on the supply conduit 2. Thus, such rotation makes it possible not only to "untangle" the supply conduit 2 quickly, i.e., in the space of several seconds or several minutes, but also to facilitate the rotational movements of a device 20 according to the invention.

According to FIG. 3*a*, the collector 24 can have a shape close to a "?" to collect, from the base 24*c*, and distribute via a bent arm 24*a*, the pressurized fluid to the primary nozzle 22, respectively. The collector 24 is rigidly connected to the primary nozzle 22. According to a second embodiment described in connection with FIG. 4, when the device according to the invention includes two primary nozzles, the collector 24 can have a shape close to a "Y" in order to collect, from the base 24*c*, and distribute via the bent arms 24*a*, the pressurized fluid to the primary nozzle 22, respectively. An arm 24*a* thus includes a portion comprising a potential connecting elbow 25 in order to orient the primary nozzles 22 from the bow toward the stern of the propulsion device. It is possible to consider other configurations of the collector 24, said configurations depending on the number of primary nozzles of the propulsion device 20 according to the invention. Furthermore, FIG. 5 has a third embodiment of the means for collecting and distributing a fluid from a propulsion device 20 according to the invention. Such means for collecting and distributing a fluid can advantageously include a collector 24 and be positioned essentially at the stern of the platform 21. Such a collector 24 can advantageously have a shape substantially close to a "U" in order to collect, from a base 24*c*, and distribute via a connecting elbow 27, advantageously with a curve radius in a median plane of the platform 21, the pressurized fluid to the primary nozzle. Such a connecting elbow 27 can advantageously assume the form of a "C" and makes it possible, thanks to its clever arrangement, to decrease the pressure losses within the means for collecting and distributing the fluid while reducing the speed of the fluid before said fluid enters the primary nozzle 22. This decrease in pressure losses itself guarantees, for a given power of the compression station, a boosting of the performance achieved by such a propulsion device 20.

Furthermore, a primary nozzle 22 generally has a substantially circular section. However, as illustrated in connection with FIGS. 6, 7*a* to 7*c* and 8*a* to 8*c*, in addition to the oblong section of the elbow, the section of the primary nozzle 22 can also be substantially oval or elliptical. Said section of the nozzle is preferably substantially oblong. The term "oblong" designates a shape that is longer than it is wide and the corners of which are rounded, as illustrated in connection with FIGS. 7*a* to 7*c* and 8*a* to 8*c*. This configuration in particular makes it possible, for same compression station power, for the pressure losses within a propulsion device according to the invention to be decreased and for the performance of a propulsion device including a substantially oblong primary nozzle section 22 to be boosted. Furthermore, the oblong section makes it possible to avoid friction between the expulsion of the fluid and the lower surface 21*i* of the platform.

Alternatively, said connecting elbow 27, a portion of or even the entire collector 24, can advantageously include an oblong section, as illustrated in connection with FIGS. 6, 7*a* to 7*c* and 8*a* to 8*c*. Such an oblong section makes it possible to increase the performance of the device by allowing a tighter curve of the connecting elbow 27, and consequently, by decreasing the pressure losses in the collector and thus maximizing the performance. Furthermore, other advantages should be noted due to the presence of such an oblong section:

the bulk resulting from the collecting and distributing means is greatly decreased, making it possible to greatly decrease the width of the platform 21 and making the device 20 according to the invention more compact;

the impact of the device on the fluid above which the device moves is damped due to the small bulk as opposed to a substantially circular section, thus the gliding of the device is improved during the landing of such a device;

due to the decreased bulk, the distance between the platform 21 and the fluid outlet is decreased, facilitating the control of the incline of the platform 21 via the feet of the passenger 1 or more generally improving the ergonomics and intuitiveness of the device 20 according to the invention.

Figure 7A:
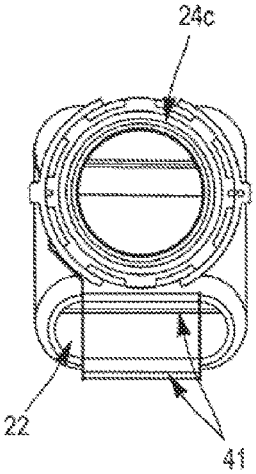
FIGS. 7*a*, 7*b*, 7*c*, 8*a*, 8*b* and 8*c* illustrate specific configurations of means for collecting and distributing a fluid and of the primary nozzle of a propulsion device according to the third embodiment of the invention.
Figure 7B:
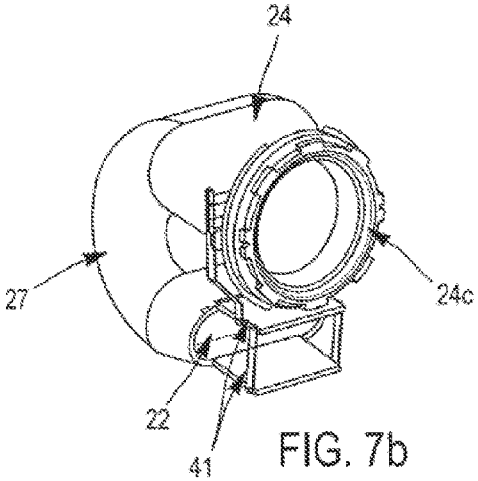
Figure 7C:
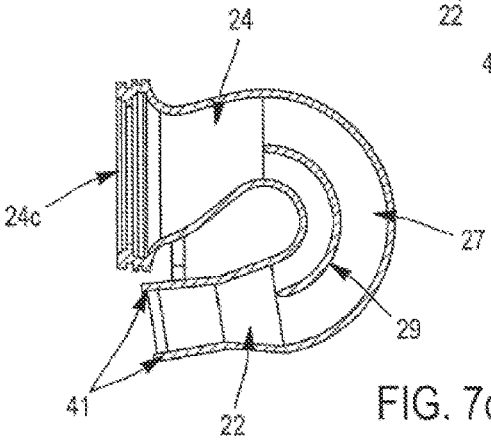
Figure 8A:
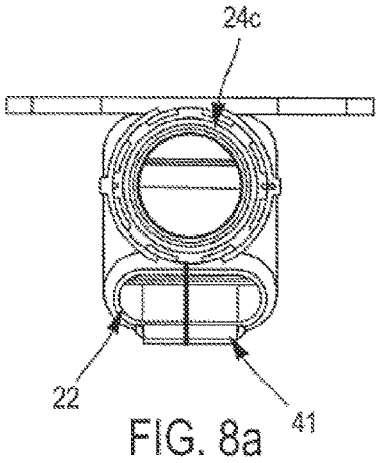
Figure 8C:
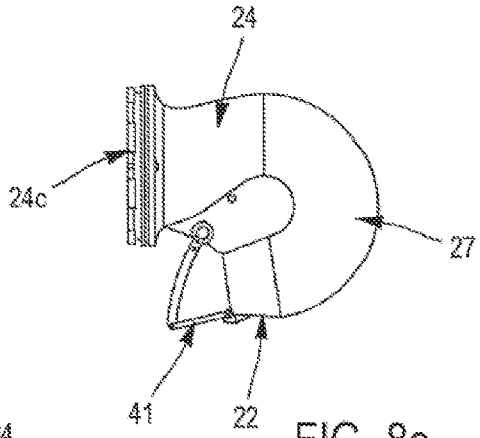
Figure 8B:
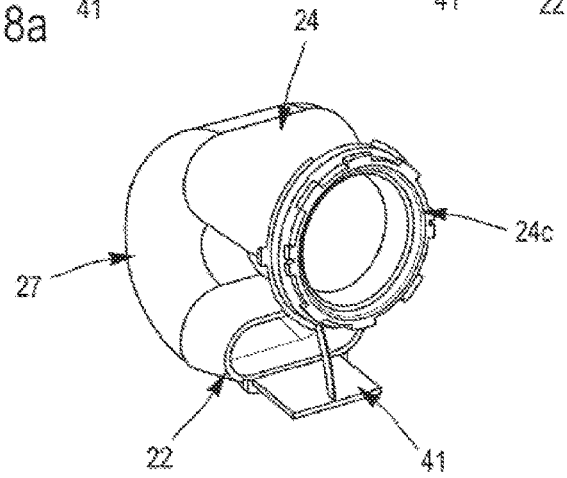

Additionally, according to FIGS. 5 and 7*c*, said connecting elbow 27 can include a directional blade 29 that also enables a decrease in pressure losses and boosted performance. Such a directional blade 29 may consist of a paddle, the profile of the blade reproducing the advantageous shape of the connecting elbow 27. It thus includes a curve radius concentric to that of the connecting elbow 27. It can advantageously be positioned over the entire length of the connecting elbow 27, at a distance from the wall describing the inner curve of said elbow corresponding to one third of the height of the oblong section of said elbow 27: the blade makes it possible to steer the flow of molecules of the fluid during their passage in the directional elbow and to avoid slowing of the flow caused by the impact of the fluid molecules. The performance of the propulsion device is thus increased and the pressure losses are ultimately decreased.

Additionally, in order to best direct the expulsion of the fluid, decrease the pressure losses and thus boost the performance of a device 20 according to the invention, a primary nozzle 22, including an oblong section at the fluid outlet, can advantageously comprise one or several directional flaps 41. Such configurations are illustrated in connection with FIGS. 7*a* to 7*c* and 8*a* to 8*c*: the fluid outlet of the primary nozzle 22 is oblong, as a result of which such an outlet includes two substantially rectilinear and parallel segments. The flaps 41 cooperate with said segments, i.e., they are secured using any means. The presence of one or several directional flaps 41 makes it possible to increase the speed and makes it possible to perform tight turns optimally. To that end, advantageously, the position and/or angle of the flaps 41 can be adjusted beforehand, the flaps 41 thus remaining static during the use of the device 20 according to the invention. Alternatively, the position and/or angle $\theta$, described by a normal to the flap and by the fluid outlet direction in a median plane PM of the platform, of the directional flaps 41 can be adjusted dynamically or automatically, like the adjustment of the angle $\alpha$ for the primary nozzle 22:

dynamically, before any use or during the use of the propulsion device 20, the passenger 1 can adjust the position and/or the angle θ using input and control means, as a non-limiting example, such as a remote control, in wired or wireless contact with an onboard calculator the propulsion device;

automatically, during the use of the propulsion device 20, the position and/or the angle being able to be adjusted directly thanks to the use of one or several inclinometers, cooperating with the calculator, the latter determining the appropriate position and/or angle based on the movements made by the passenger 1 or the acceleration of the device 20 according to the invention.

Thus, the angle θ makes it possible to adjust the angle α of the fluid direction, guided by the nozzle 22. In such configurations, the directional flaps 41 will be considered "articulated". The control means for the different angles α, β and θ and positions of the nozzles with respect to the bow can advantageously consist of a single and same entity, i.e., a calculator, to simplify the implementation of the device 20 and to ensure optimal comfort for the passenger 1. The actuation of a directional flap, the orientation and positioning with respect to the bow of a fluid outlet can be done by actuators controlled electrically, pneumatically or hydraulically transmitting a control delivered by a calculator in response to an input delivered by a remote control and/or a measurement from sensors of the device. Furthermore, preferably, at least one directional flap 41 will be present on the fluid outlet of a primary nozzle 22: such a directional flap 41 is advantageously positioned several millimeters past the inner walls of the primary nozzle 22 to avoid any contact between the fluid outlet and said flap, said contact being able to substantially modify the fluid expulsion direction. However, both directional flaps 41 can be present. As previously described, the two flaps are advantageously positioned several millimeters past the inner wall of the primary nozzle 22 in order to avoid any contact between the fluid outlet and said flap. Due to the presence of two flaps, different arrangements are also possible in this configuration:

only one of the two flaps 41 can be articulated, the other flap for example being able to be molded with the fluid outlet according to a predetermined orientation;

both flaps can be articulated: according to FIGS. 7*a* to 7*c*, so as not to block the expulsion of the fluid by the primary nozzle, both flaps 41 can advantageously cooperate with one another using fastening and/or attaching means. Such means guarantee that the angle described between the flaps 41 is substantially equivalent or equal to the natural angle described by the expelled fluid. Such an arrangement makes it possible to eliminate any pressure loss.

Surprisingly, the nozzle with "oblong section-directional flap(s)" assembly is adaptable to any type of motorized water vehicle. Such an assembly can advantageously replace a fluid outlet provided with a directional nozzle. In such a configuration, the oblong section 10, advantageously but non-limitingly, can be in the vertical position. Thus, a fluid outlet with an oblong section, provided with two directional flaps 41 mutually steerable in a median plane, can equip any turbining motorized water vehicle. The power and maneuverability of the latter will be heightened as a result. The pressure losses are practically zero.

The invention further considers that the propulsion device 20 according to the invention includes a fairing 43 cooperating with the platform 21. As illustrated in connection with FIG. 3*b*, such a fairing 43 can consist of the form of an outer coating and can have different functions based on its position relative to the platform 21. Alternatively, the fairing 43 and the platform 21 can be molded together in a single piece.

The fairing 43 can cooperate with the lower face of the platform 21: this advantageous configuration makes it possible to protect the thrust unit and part of the means for collecting and distributing the pressurized fluid of a device 20 according to the invention, but also to optimize the gliding of such a device on the surface of a fluid. Furthermore, such a fairing may:

allow joint holding of all of the components of a propulsion device 20 according to the invention;

provide an aesthetic side to the assembly;

contain one or several safety features: the fairing 43 can "house" a safety device, including but not limited to an airbag, so that when a fall occurs on a solid surface, the landing of a passenger 1 can be less difficult and/or violent;

include buoyancy means such as, by way of non-limiting example, an inflatable buoy, to avoid drowning upon any fall into a fluid such as water.

A fairing 43 can be secured rigidly to said lower face 21*i* and houses at least the thrust unit. However, the fairing may advantageously house the collector 24 in addition to primary or even secondary nozzles. According to these different alternatives, the fairing advantageously includes openings for allowing the fluid outlets of the nozzles to emerge and expel the fluid. Preferably, such a fairing may be substantially "V-shaped", this shape being suitable for allowing the damping of shocks with the fluid that may be in contact with the propulsion device 20 according to the invention. Such a general V-shape allows an increase in the penetration of the propulsion device 20 into said fluid. As a non-limiting example, when the device 20 according to the invention includes two primary nozzles, a fairing 43 with an appropriate shape may advantageously correspond to a fairing including two V-shaped hulls parallel to one another, such as, by way of non-limiting example, the hulls of a catamaran.

Alternatively, or additionally, the fairing may cooperate with the upper surface of the platform, advantageously but non-limitingly, the bow of the platform 21. Such an arrangement is particularly advantageous when the passenger 1 is in the elongated position, as shown in FIG. 2*b*. Indeed, the fairing, during such a configuration, performs a "deflector" function, i.e., it modifies the flow of the air and/or the fluid on the surface of which a passenger 1 moves and thus ensures the "comfort" of the passenger 1.

The invention also provides that the platform 21 can have means for ensuring the maintenance 28 of a passenger on the platform 21 comfortably, in complete safety. A passenger 1 may assume different positions on the platform 21 based on the sensations that that passenger 1 wishes to have. The possible positions in particular include:

an "upright" position, similar to a position that may be assumed by a surfer on a surfboard, illustrated in connection with FIG. 2*a;* an "elongated" position, similar to a position that may be assumed by a rider on a bodyboard, illustrated in connection with FIG. 2*b;* a "segway" position, close to that which a passenger may assume on a self-balancing personal transporter;

a substantially seated position, allowing the "submarine" configuration.

Thus, depending on the preferred position of a passenger 1 on the platform 21 of a device according to the invention, as a non-limiting example in the "upright" position, said maintaining means 28 may consist—as indicated in FIG.

1—of a pair of foot straps, slippers or fastening boots of a similar type to what can for example be found in wakeboarding.

Alternatively, other types of maintaining means 28 may be preferred when one wishes to help the passenger maintain an elongated position. Such means 28 may include gripping means such as, but not limited to, one or several tubes (not shown in FIGS. 2*a*, 2*b*, 3*a* to 3*d* and 4 to 6) serving as handles. Such tubes can be positioned in different locations on the upper surface 21*s* of the platform or at the front of the platform 21. Additionally, the tube(s) may advantageously be hollow so as to contain input or control means, independent or shared, within them in order to:

control the fluid compression power of a remote compression station delivering the pressurized fluid;

adjust the different angles relative to the primary and secondary nozzles;

adjust the distance between the primary nozzle(s) and the bow of the platform.

Alternatively, the gripping means maybe cylindrical, having an outer diameter arranged to insert control means including a body having an appropriate female groove or hole.

Advantageously, said input and/or control means can also cooperate with the tube(s) while being, as a non-limiting example, secured to said tubes using any means. Such input and/or control means can advantageously consist of the form of a remote control delivering inputs via one or several wired or contactless communications with actuators, a calculator or even the remote fluid compression station.

To that end, irrespective of the configuration or alternative embodiment of a propulsion device according to the invention, the latter advantageously includes safety means to protect the integrity of the passenger in case of fault or failure by the latter, as well as to avoid any uncontrolled movement of the propulsion system including said propulsion device, the pressurized fluid supply conduit and the remote compression station. Such safety means can be partially integrated into a remote control held by the passenger to control the power of the compression station or to adjust certain elements of the devices dynamically, such as the flaps, valves, positioning actuators for the nozzles, etc. Such safety means can also be separated from said remote control. In all cases, said safety means can in particular implement two modes for generating safety inputs, voluntary or by default, controlling the stopping of the compression motor of the compression station, said stopping optionally being preceded by a gradual decrease of the compression power during a predetermined period, generally several seconds. This stopping input may be conveyed by a cable or more generally by a wired connection connecting the safety means to the compression motor, or to control means of the latter onboard the remote compression station. Such an input can also be transmitted by wireless communication, for example radio or acoustic, established between the safety means and said remote compression station. The input can, alternatively, be conveyed by wired or wireless communication to a calculator onboard the propulsion device, advantageously that interpreting all of the inputs of the passenger so as, for example, to steer or adjust a nozzle of the device. This calculator is responsible for interpreting this safety input by controlling stopping of the compression station strictly speaking, said stop control being transmitted in turn by the calculator to the compression station by wired or wireless means. Irrespective of the selected solution to connect the safety means to the compression station, directly or indirectly via the calculator, said safety means can advantageously include a man-machine interface, for example a button or trigger of a remote control, which, when actuated by the passenger, generates the safety inputs whereof the interpretation by the compression station or the calculator of the device causes the stopping of said remote compression station, said stopping advantageously being gradual. Alternatively, or additionally, such an input may be generated by the release by the passenger of an action on a man-machine interface, for example a button or trigger. As one preferred example, if such an interface is no longer biased by the passenger during a predetermined period, advantageously several seconds, the safety input is generated by the safety means. Such a solution makes it possible to detect a failure or uneasiness of the passenger. Alternatively, or additionally, the safety means can consist of a transmission of a continuous signal, the breaking of which may be interpreted by the calculator as a safety input. This alternative may be particularly interesting when the safety means communicate with said calculator via a wireless link. The transmission of said signal by the safety means can be provided to ensure a nearby communication, approximately one to two meters, for example, with the calculator. Thus, a fall by the passenger, the latter moving away, jointly with the safety means, for example his wireless remote control, from the safety device beyond a safety distance, corresponding to the maximum transmission range of the signal, no longer makes it possible for the signal to be conveyed from the safety means to the calculator. The latter then interprets this break in the communication as a safety input. Furthermore, such a signal may be conveyed by a cable connecting the safety means to the calculator by an attachment arranged to give way when the passenger falls. The signal is then no longer transmitted to the calculator. Also alternatively, said cable may be a conventional cutout switch, keeping a terminal of the calculator at a reference potential as long as said cable is connected to said calculator. The detachment of the cable when a fall occurs causes a variation in the potential of said terminal, said variation being interpreted by the latter as a safety input. All other configurations or arrangements of such safety means may be considered. Such safety means associated with a calculator onboard a propulsion device according to the invention, or in communication with control means for the compression motor of the remote compression station, could be adapted to equip any other device for propelling a passenger, as long as said device is supplied with pressurized fluid by a remote compression station. Furthermore, any other input from the passenger, for example via a remote control, seeking to regulate the compression power of the motor of the remote compression station, can be conveyed from an appropriate man-machine interface of said remote control, for example a trigger or lever, to said station directly or via the calculator of the propulsion device using a wired connection or wireless connection. Such a connection can be mixed, i.e., wired between the remote control and the calculator, wireless between the calculator and the compression station, or vice versa.

Alternatively, or additionally, according to FIG. 2*b* , when a passenger 1 wishes to retain an "elongated" position, a device according to the invention can include gripping means advantageously assuming the form of a sleeve 28' or handlebars, placed at the bow of the platform 21, as illustrated in connection with FIG. 2*b* Such a sleeve 28' is similar to the handlebars present on bicycles or scooters. It not only allows the passenger 1 to maintain himself on the platform 21 in a chosen position, but also to direct the movement of the device 20 according to the invention, depending on whether the passenger 1 is moving in the air, on the surface of water or beneath the water. Such a sleeve 28' is preferably used to guarantee more optimal maneuverability. Like the tubes previously described, the sleeve 28' can advantageously be hollow and contain, or more generally cooperate with, control means, such as, by way of non-limiting example, a wired or wireless remote control. Furthermore, such a sleeve 28' can be removable, i.e., it can be moved, taken off, detached or directly inserted within the fairing of the device 20 according to the invention. Such an arrangement makes it possible to reduce the bulk of the device 20, which assumes the form of an "all-in-one" adaptable device that is very easy to manipulate.

Alternatively, the maintaining means can include seating means: the upper surface 21*s* can be arranged so as to receive a passenger 1 in the "seated" position. Such seating means can, advantageously but non-limitingly, consist of a saddle, a bump or a hollow to receive the buttocks of said passenger 1 and allow him to move in the seated position, calmly, comfortably and safely.

Furthermore, the maintaining means can advantageously be arranged so the passenger can place himself along the platform, for example in the "segway" position as previously described. The maintaining means can also comprise bearing means for the feet, as a non-limiting example, according to FIG. 3*a* , "foot wedges" 28". Advantageously, like the sleeve 28' , the foot wedges 28" can be removable, telescoping, i.e., the different parts that make up the foot wedges nest and slide in one another, or retractable, i.e., the fairing of the device 20 according to the invention includes appropriate housings to conceal said foot wedges.

Lastly, as previously specified, the propulsion device 20 according to the invention is reversible for use as a "submarine". The primary nozzle 22 and/or the reinforcing arm 42 can advantageously include a coating made from an appropriate material, such as a foam, so as to create seating means, for example a seat, so that a passenger 1 can position himself on said device 20.

A propulsion device according to the invention, for example like the device 20 described as an example in connection with FIGS. 2*a*, 2*b*, 3*a*, 3*b*, 3*c*, 4, 5 and/or 6, can be supplied by any remote fluid compression station as long as the latter is able to deliver a fluid having a sufficient pressure for the operation of the propulsion device. The latter can be dedicated to that use, at the risk of increasing the overall cost of a propulsion system including a propulsion device according to the invention, a remote compression station and a supply conduit cooperating with said device and station to convey the pressurized fluid.

In order to decrease such a cost, the invention also provides that the remote compression station can be an apparatus whose original primary function is different from supplying a pressurized fluid for a propulsion device. As an example, the invention provides that a land or water firefighting vehicle can be operated as a remote compression station if it has a sufficient fluid compression capacity.

Figure 9:
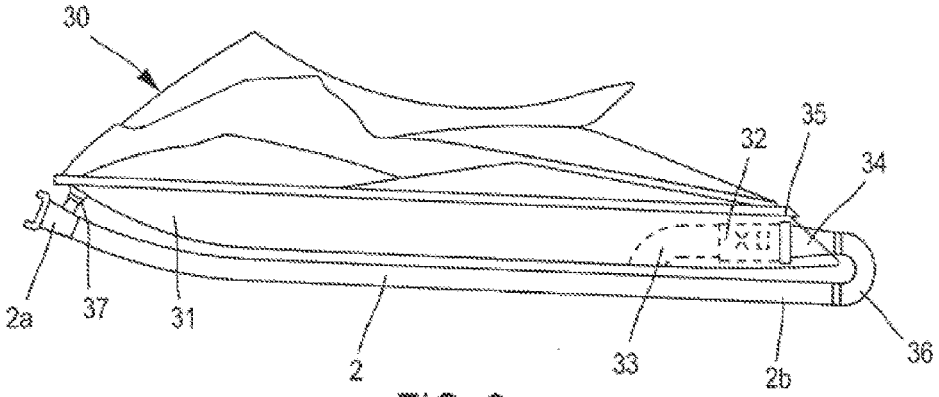
FIG. 9 shows a schematic view of a motorized water vehicle adapted as a remote compression station.

Alternatively, or additionally, the invention further proposes taking advantage of the natural compression capacity of a fluid of a motorized water vehicle (MWV), such as the RUNABOUT MZR, 2011 edition by the builder ZAPATA RACING. Such a vehicle 30, a side view of which is described in connection with FIG. 9, includes a hull 31 and houses propulsion means 32 compressing a fluid by turbining, on the surface of which fluid the MWV is navigating, said fluid being ingested from an inlet 33 arranged below the hull 31. Said fluid thus pressurized is expelled from a fluid outlet 34 situated at the rear of the vehicle. Such a fluid outlet generally consists of a nozzle cooperating with a directional (not shown in FIG. 9) to modify the trajectory of the MWV. The means 32 are generally driven using a heat engine, also not shown in FIG. 9. In order to guarantee the use of the MWV as a remote compression station, a flange 35 is applied on the fluid outlet 34, then connected to an end-piece 2*b* of a supply conduit 2 in order to convey the pressurized fluid expelled from the fluid outlet of the MWV. The supply conduit 2 is connected, at the other end, using an end-piece 2*a*, to the means 24 for collecting and distributing the pressurized fluid to the nozzles of a propulsion device according to the invention like the device 20 described in connection with FIGS. 2*a*, 2*b*, 3*a*, 3*b*, 3*c*, 4, 5 and 6.

The invention has been described during its implementation on the surface of and/or in the water. It may also be implemented on the surface of any suitable fluid, and more particularly in the air.

It will be appreciated by persons skilled in the art that the present invention is not limited to what has been particularly shown and described herein above. In addition, unless mention was made above to the contrary, it should be noted that all of the accompanying drawings are not to scale. Of note, the system components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. Moreover, while certain embodiments or figures described herein may illustrate features not expressly indicated on other figures or embodiments, it is understood that the features and components of the examples disclosed herein are not necessarily exclusive of each other and may be included in a variety of different combinations or configurations without departing from the scope and spirit of the invention. A variety of modifications and variations are possible in light of the above teachings without departing from the scope and spirit of the invention, which is limited only by the following claims.

What is claimed is:

1. A propulsion device, comprising:

a platform defining an upper surface, a lower surface, a bow, and a stern, wherein the platform defines a longitudinal axis extending from the bow to the stern;

a fluid collector coupled to the lower surface of the platform such that at least a portion of the fluid collector extends below the upper surface of the platform, the fluid collector being positioned at the stern of the platform and facing in a bow-to-stern direction such that fluid enters the fluid collector in a stern-to-bow direction;

a flexible fluid supply conduit coupled to the fluid collector for providing pressurized fluid to the collector; and a primary nozzle in fluid communication with the fluid collector and configured to expel a fluid towards the stern, wherein the primary nozzle is selectively adjustable such that a projection, in a vertical plane, of a direction of the fluid expelled from the primary nozzle defines an angle a with the longitudinal axis, the angle $\alpha$ being selectively adjustable between −10° and +45°.

2. The propulsion device according claim 1, wherein the fluid collector is pivotable with respect to the supply conduit.

3. The propulsion device according claim 1, wherein the platform comprises a plurality of surface segments coupled to one another to form the upper and lower surfaces.

4. The propulsion device according claim 1, wherein a distance between the primary nozzle and the bow of the platform is selectively adjustable.

5. The propulsion device according claim 1, further comprising two co-planar secondary nozzles coupled to the lower surface of the platform.

6. The propulsion device according claim 5, wherein secondary nozzles define an angle β between each other that is between 60° and 120°.

7. The propulsion device according claim 5, wherein the primary nozzle and the secondary nozzles constitute a single fluid manifold.

8. The propulsion device according claim 5, wherein fluid flow through each of the secondary nozzles is selectively adjustable.

9. The propulsion device according claim 8, wherein fluid flow through each of the secondary nozzles is selectively adjustable through operation of at least one of an electrical, hydraulic or pneumatic actuator.

10. The propulsion device according claim 1, wherein the angle α is selectively adjustable through operation of at least one of an electrical, hydraulic or pneumatic actuator.

11. The propulsion device according claim 1, further comprising a directional fluid outlet movably coupled to the primary nozzle.

12. The propulsion device according claim 11, wherein the directional fluid outlet is selectively adjustable through operation of at least one of an electrical, hydraulic or pneumatic actuator.

13. The propulsion device according claim 1, further comprising a directional flap coupled to the primary nozzle.

14. The propulsion device according claim 1, wherein the directional flap is movable about the primary nozzle.

15. The propulsion device according claim 1, further comprising bindings configured to secure a passenger's feet to the upper surface of the platform.

16. The propulsion device according claim 1, further comprising a remote compression station supplying pressurized fluid to the flexible supply conduit.

17. The propulsion device according claim 16, wherein the remote compression station includes a motorized water vehicle.

18. The propulsion device according claim 1, configured to automatically adjust the angle α based on an inclination of the propulsion device and input by an onboard calculator.

19. A propulsion device, comprising:

a platform defining an upper surface, a lower surface, a bow, and a stern, wherein the platform defines a longitudinal axis extending from the bow to the stern;

a fluid collector coupled to the lower surface of the platform such that at least a portion of the fluid collector extends below the upper surface of the platform, the fluid collector being positioned at the stern of the platform and facing in a bow-to-stern direction such that fluid enters the fluid collector in a stern-to-bow direction;

a flexible fluid supply conduit coupled to the fluid collector for providing pressurized fluid to the collector; and a primary nozzle in fluid communication with the fluid collector and configured to expel a fluid towards the stern, wherein a projection, in a vertical plane, of a direction of the fluid expelled from the primary nozzle defines an angle α with the longitudinal axis, the angle α being between −10° and +45° .

20. The propulsion device according claim 19, wherein the fluid collector and the primary nozzle intersect a common vertical plane extending along the longitudinal axis of the platform.

* * * * *